United States Patent [19]

Miletic

[11] 4,152,707

[45] May 1, 1979

[54] ANTENNA FEED SYSTEM

[75] Inventor: Igor Miletic, Scarborough, Canada

[73] Assignee: U. S. Philips Corporation, New York, N.Y.

[21] Appl. No.: 821,708

[22] Filed: Aug. 4, 1977

[30] Foreign Application Priority Data

Aug. 11, 1976 [CA] Canada ..... 258905

[51] Int. Cl.[2] ..... H01Q 21/12; H01Q 21/00

[52] U.S. Cl. ..... 343/814; 343/844; 343/853

[58] Field of Search ..... 343/811, 812, 814, 844, 343/853

[56] References Cited

U.S. PATENT DOCUMENTS

| | | | |
|---|---|---|---|
| 1,904,174 | 4/1933 | Strutt et al. | 343/844 |
| 2,290,314 | 7/1942 | Carter | 343/811 |

FOREIGN PATENT DOCUMENTS

| | | | |
|---|---|---|---|
| 411947 | 1945 | Italy | 343/814 |

*Primary Examiner*—Alfred E. Smith
*Assistant Examiner*—Harry E. Barlow
*Attorney, Agent, or Firm*—Thomas A. Briody; William J. Streeter; Henry I. Steckler

[57] ABSTRACT

An antennae feed or take-off for a plurality of antennae where the transmission line, connecting the antennae to the termination of the line, is in a closed loop whereby signal flows either direction and transmission line phase shifts are largely compensated.

3 Claims, 3 Drawing Figures

ANTENNA FEED SYSTEM

This invention relates to a system for deriving from or feeding to an array of spaced antennas a radio frequency signal wherein a desired phase relationship is maintained between the signals at the different antennas or when signals are fed back an accurate copy of the signal, both in amplitude and phase, is provided at a remote point. The latter type of device, generally termed an antenna monitor system, is very useful in monitoring the performance of the antenna array as a whole. The invention will be described primarily with respect to its use in a monitoring system wherein the spaced antennas are each alone associated with a further antennas for radiating electromagnetic energy and derive a signal therefrom.

In order that the derived antennas signals properly represent the signals at the individual antenna the transmission line used to provide the signals must be accurately cut to length between the individual antenna and between the array and the terminal to which the signals are supplied so that proper phase shift differences are maintained between the signals supplied to the remote point or common terminal.

It is substantially impossible to cut transmission lines with the accuracy required and discrepancies result in phase shifts taking place in the transmission lines lengths so that the signals derived do not accurately represent the signals at the antennas in phase or amplitude. Furthermore weather conditions may increase the problem. Fortunately, transmission line losses are generally small and of small consequence.

In order to minimize the adverse effects of transmission line length discrepancies, mismatching and weather conditions, it has been found that when the transmission line lengths form a closed loop system the problem is substantially alleviated.

Figure 1A:
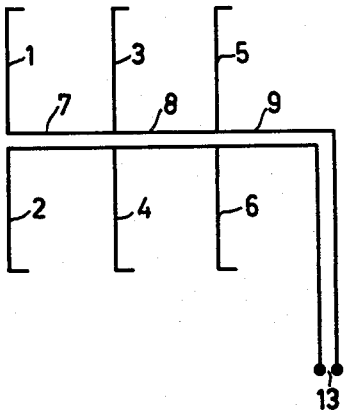
Figure 1B:
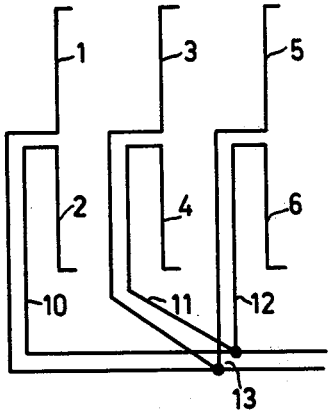
Figure 2:
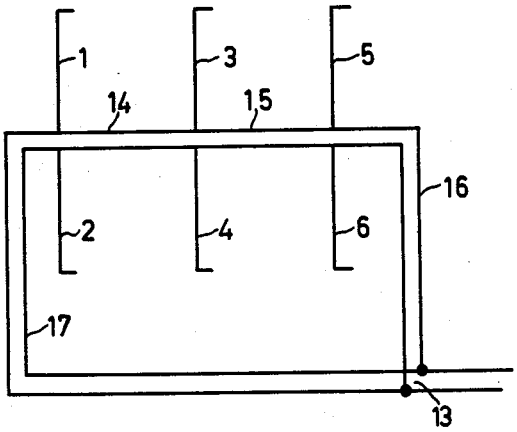

In order to provide a clearer understanding of the invention it will now be described with reference to the figures of the drawings in which, FIGS. 1(*a*) and 1(*b*) show the prior art antenna coupling and feeding systems, and FIG. 2 shows the improved system according to the present invention.

FIG. 1(*a*) shows an antenna array comprising three double dipoles 1–2, 3–4 and 5–6, each associated with a further antenna (not shown) radiating electromagnetic energy and connected as shown in series in a transmission line path including lengths 7, 8 and 9 feeding an output terminal 13. It is assumed that the lengths 7, 8 and 9 each constitute an even number of electrical equivalent wavelengths with respect to the frequency of the signal with which the system is concerned. FIG. 1(*b*) shows a system in which the individual antenna of the array are each coupled to terminal 13 by individual transmission lines of equivalent electrical wavelength.

In each of the systems of FIG. 1, when used for monitoring purposes, and with precautions taken, substantial phase discrepancies still exist between the signals at each antenna and their representations at terminal 13. These discrepancies vary with temperature, humidity, etc. and, as a consequence, the systems are not suitable for monitoring where accurate determination of signals conditions at the antenna array must be made as, for instance, in an alarm system for an electromagnetic aircraft localizer system.

It has been found that when a closed loop transmission line system, as shown in FIG. 2, replaces the transmission line systems used in FIGS. 1(*a*) and 1(*b*) the overall effect of inaccuracies in lengths of transmission lines and ambient climate conditions is substantially minimized and a practical application showed an approximate 20:1 improvement.

The improved performance results from the fact that each resultant signal at the terminal 13, representing the signal at any particular dipole, is comprised by the sum of signals passing through all lengths of the transmission lines.

For example assume that the phase shifts in lengths 14, 15, 16 and 17 are $+10°$, $+6°$, $-8°$ and $+16°$ respectively with zero loss.

Consider for the moment only dipoles 1, 2 and 5, 6 with lengths 14, 15 and dipole 3, 4 missing. At terminal 13 the signal from dipole 5, 6 is retarded 8° while that from 1, 2 is advanced 16°. The total phase difference is 24°. If now we insert lengths 14 and 15, still ignoring dipole 3, 4 the signal from antenna 1, 2 at terminal 13 is the sum of the signal mentioned above, advanced 16°, and a second signal arriving via lengths 14, 15 and 16 with a phase of $10°+6°-8°$ or $+8°$. The resultant signal representative of the energy at antenna 1, 2 is the vector sum of a first signal advanced 16° and a second signal advanced 8° with a resultant $+12°$ phase shift.

The signals received from dipole 5, 6 are a first retarded $-8°$ and a second advanced $(6°+10°+16°)$ or 32°. The resultant is a signal with a phase of $+12°$ the phase shifts in the resultant signals is the same for each dipole and the signals at terminal 13 accurately represent the respective signals at each dipole and error is eliminated.

In a similar manner it can be shown that when dipole 3, 4 is considered the resultant signal at terminal 13 will also exhibit a $+12°$ phase shift.

It will now be apparent that the closed loop feeding system, considering lossless lines, provides a means of eliminating phase errors due to line length inaccuracies etc. When lines with losses, which are generally very small, are considered the compensation for phase errors is not quite as accurate but, nevertheless, is much greater than the open ended feed systems employed in the prior art.

Although a specific embodiment of my invention has been described it will be obvious, to those skilled in the art, that modifications thereof may be carried out without departing from the spirit and scope of the invention as set forth in the appended claims.

What is claimed is:

1. A transmission line system comprising a first forward feed transmission line means for successively connecting a common terminal to a plurality of antennas so that transmission line phase shift difference between the electromagnetic signal energy present at the antennas substantially correspond respectively with the phase difference of signals appearing at the common terminal, and a second forward feed transmission line means for forming a closed loop with the first transmission line means so that the closed loop transmission line spatially successively connects the common terminal in series in the loop with the plurality of antennas, both of said transmission line means carrying substantially equal amplitude signals.

2. The transmission line system as claimed in claim 1, wherein the common terminal comprises input means for an antenna monitoring system and each individual antenna of the plurality is alone associated with one further radiating antenna.

3. The transmission line system as claimed in claim 1, wherein the common terminal comprises input means for supply of a radio frequency signal to the plurality of antenna.

* * * * *